US009759019B2

(12) United States Patent
Sulima et al.

(10) Patent No.: US 9,759,019 B2
(45) Date of Patent: Sep. 12, 2017

(54) TUBULAR JOINT ELEVATOR AND METHOD

(71) Applicant: Canrig Drilling Technology Ltd., Houston, TX (US)

(72) Inventors: Stanislaw Casimir Sulima, Spring, TX (US); Beat Küttel, Spring, TX (US); Faisal J. Yousef, Houston, TX (US)

(73) Assignee: Canrig Drilling Technology, Ltd., Dallas, TX (US)

( * ) Notice: Subject to any disclaimer, the term of this patent is extended or adjusted under 35 U.S.C. 154(b) by 526 days.

(21) Appl. No.: 13/962,408

(22) Filed: Aug. 8, 2013

(65) Prior Publication Data

US 2015/0041150 A1 Feb. 12, 2015

(51) Int. Cl.
*E21B 19/06* (2006.01)
*E21B 19/16* (2006.01)

(52) U.S. Cl.
CPC ..... *E21B 19/06* (2013.01); *E21B 19/16* (2013.01)

(58) Field of Classification Search
None
See application file for complete search history.

(56) References Cited

U.S. PATENT DOCUMENTS 3,915,244 A 10/1975 Brown
6,073,699 A * 6/2000 Hollingsworth, Jr. .. E21B 19/06 166/379
6,494,273 B1 12/2002 Martin
7,363,991 B2 4/2008 Baer
2008/0093870 A1 4/2008 Ellis et al.
2010/0300704 A1 12/2010 Sweeney et al.
2014/0099175 A1* 4/2014 Guidry ..... B66C 1/445 414/22.51

FOREIGN PATENT DOCUMENTS

WO WO 2012/091727 A1 7/2012

OTHER PUBLICATIONS

PCT, PCT/US2014/046269, "International Search Report," Oct. 29, 2014, 4 pages.
PCT, PCT/US2014/046269, "Written Opinion of the International Searching Authority," Oct. 29, 2014, 10 pages.

* cited by examiner

*Primary Examiner* — Caroline Butcher
(74) *Attorney, Agent, or Firm* — Haynes and Boone LLP

(57) ABSTRACT

A tubular joint elevator includes a ringed portion configured to lift a tubular joint. The elevator includes an elevating mechanism disposed adjacent to the ringed portion, and configured to elevate the tubular joint. In some embodiments, the elevator includes first, second, and third doors. The elevator includes a first locking member, and the first door includes a first locking recess. The first locking member is axially displaceable between an advanced position and a retracted position such that it is either received in or separated from the first locking recess. The third door includes a locking pin, and the first door comprises a locking hole. The third door is longitudinally displaceable between a first position and a second position such that the locking pin is either separated from, or received in, the locking hole. Methods of using the same are also included.

30 Claims, 11 Drawing Sheets

TUBULAR JOINT ELEVATOR AND METHOD

FIELD OF THE DISCLOSURE

The present disclosure relates to a top drive for boring or penetrating the earth during oil and gas well drilling, and an associated apparatus for elevating tubular joints, and methods for using the same.

BACKGROUND OF THE DISCLOSURE

Top drives are used in oil and gas well drilling. Top drives are drilling tools that hang from a traveling block. Top drives include one or more motors to power a drive shaft to which a drill string or tubular joint is attached. Top drives also incorporate spinning and torque-wrench-like capabilities. A casing running tool is attached to a top drive to engage tubular joints or pipes such that the top drive may act on them (e.g., the top drive screws a tubular joint onto a tubular string). An elevator is attached to a casing running tool. Thus, there is a need for an improved elevator to handle tubular joints, and the present disclosure aims to provide such an elevator.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 2-1 is a back view of a casing running tool and joint elevator, according to one or more aspects of the present disclosure.

FIG. 2-2 is a side view of the casing running tool and joint elevator of FIG. 2-1, according to one or more aspects of the present disclosure.

FIG. 2-3 is a front view of the casing running tool and joint elevator of FIG. 2-1, according to one or more aspects of the present disclosure.

FIG. 3-1 is a back view of an elevator gripping a tubular joint, according to one or more aspects of the present disclosure.

FIG. 3-2 is a back view of the elevator of FIG. 3-1 closing around a tubular joint, according to one or more aspects of the present disclosure.

FIG. 3-3 is a front view of the elevator of FIG. 3-1, according to one or more aspects of the present disclosure.

FIG. 4-1 is a back view of a closed elevator, according to one or more aspects of the present disclosure.

FIG. 4-2 is a partial cutaway of the closed elevator of FIG. 4-1, according to one or more aspects of the present disclosure.

FIG. 4-3 is an elevator as it is preparing to open, according to one or more aspects of the present disclosure.

FIG. 4-4 is a partial cutaway of the elevator of FIG. 4-3, according to one or more aspects of the present disclosure.

FIG. 4-5 is a partial cutaway of the back of an elevator as it is opening, according to one or more aspects of the present disclosure.

FIG. 5 is a flow diagram of a process for assembling a tubular string at least partially disposed in a wellbore, according to one or more aspects of the present disclosure.

FIG. 6-1 is a back view of an elevator gripping a tubular joint, according to one or more aspects of the present disclosure.

FIG. 6-2 shows an elevating mechanism of the elevator of FIG. 6-1 contacting a tubular joint, according to one or more aspects of the present disclosure.

FIG. 6-3 shows the elevating mechanism of FIG. 6-2 elevating a tubular joint towards a component of a casing running tool, according to one or more aspects of the present disclosure.

FIG. 6-4 shows a tubular joint engaging with the component of the casing running tool of FIG. 6-3, according to one or more aspects of the present disclosure.

FIG. 6-5 shows the elevating mechanism of FIG. 6-2 retracted from a tubular joint, according to one or more aspects of the present disclosure.

DETAILED DESCRIPTION

Figure 1:
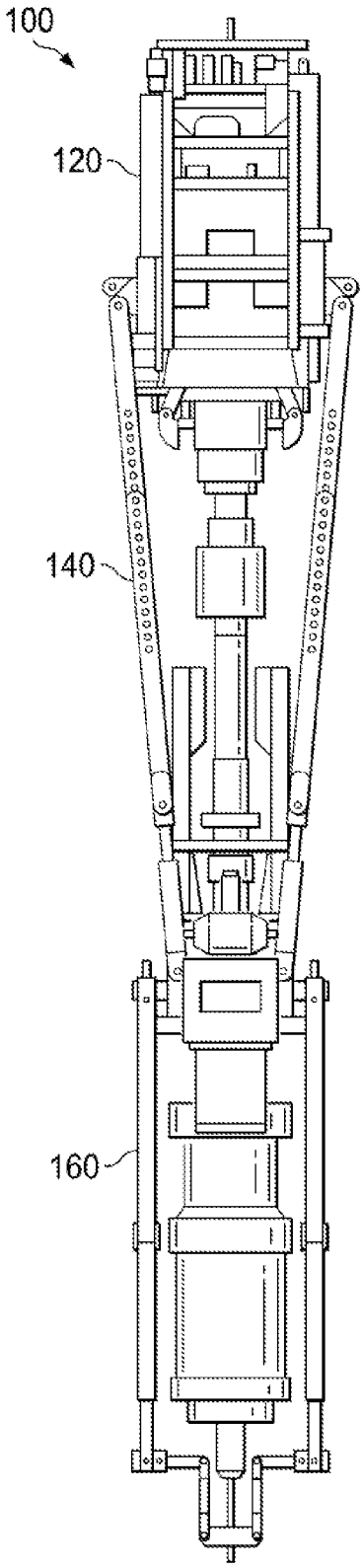
FIG. 1 is a front view of a top drive system, according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

According to one or more aspects of the present disclosure, apparatuses and methods for handling tubular joint are shown and described. Tubular joint, as used herein, may refer to a joint of casing, a joint of drill pipe, etc. An elevator may be disposed at a distal end of a casing running tool ("CRT"), and either associated therewith, or directly or indirectly coupled thereto, to provide tubulars to the CRT. While a casing running tool is specifically mentioned, in other embodiments, the elevator may be used to handle drill pipe and/or other tubular joints. Accordingly, in some embodiments, the elevator may be used without a CRT such as when the elevator is used to handle drill pipe. Thus, the description of using the elevator with the CRT herein describes one non-limiting, exemplary embodiment. Other uses of the elevator with or without the CRT are within the scope of this disclosure. The elevator may include multiple doors (e.g., three doors). In various embodiments, the elevator is configured to elevate a tubular joint into a CRT, and in one embodiment into a CRT gripper. The CRT gripper holds the tubular joints while a top drive acts on the tubular joints (e.g., applies torque to join the tubular joint to a tubular string). Tubular string, as used herein, may refer to multiple joints of casing, multiple joints of drill pipe, etc., which, in some embodiments, extend into a wellbore. Advantageously, the elevator may elevate the tubular joints into the CRT gripper in a repeatable fashion. The elevator includes an elevating mechanism, which elevate the tubular joint to the required height with a controlled speed and elevation. In one embodiment, the elevating mechanism includes one or more rollers, which, when in contact with the tubular joint, rotate and elevate the tubular joint. In other embodiments, the elevating mechanism may include elements other than or in addition to the rollers. One or more components and/or functions of the elevator are controlled from a location remote from the elevator, the CRT, and/or the top drive. The elevator includes a two-stage, independently-controlled, fail-safe locking mechanism to advantageously inhibit or prevent a tubular joint from falling to the rig floor. In stage one, pins are activated by springs and enter openings in the elevator doors, inhibiting or preventing the doors from opening. The pins can be retracted remotely by single-acting cylinders. In stage two, the tubular load resting on the elevator causes engagement of a pin of one door with a hole of the opposite door. The pin can be disengaged by removing the load from the elevator.

According to one or more aspects of the present disclosure, a method of handling a tubular joint with the elevator includes opening the doors of the elevator. The elevator's elevating mechanism (e.g., rollers, in one embodiment) may be retracted. The elevator is positioned over the tubular joint or the joint is positioned under the elevator, as desired. The elevator doors are closed around the tubular joint. The first stage of the locking mechanism engages, and mechanical latches prevent the doors from opening until desired to ensure safe handling. While the tubular joint is elevated to a vertical position, the second stage of the locking mechanism engages, and mechanical latches prevent the doors from opening. The rollers advance towards the tubular joint and make contact. The rollers rotate, when in contact with the tubular joint, elevating the tubular joint to the required height. In other embodiments, a different elevating mechanism may be used to elevate the tubular joint. The CRT gripper engages the tubular joint. The rollers retract, allowing for axial and rotational movement of the tubular joint. The elevator may include single-acting cylinders, which are pressurized. The cylinders may cause the elevator doors to be opened. The CRT, with the gripper engaging the tubular, is lowered such that the tubular joint makes contact with the tubular string, and the two are screwed together. The CRT lowers the extended string into the wellbore, and the floor retention or gripping mechanism (e.g., spider) engages and holds the weight of the tubular string. The CRT gripper disengages, and the elevator is placed over the next tubular joint or the joint is placed under the elevator, or both concurrently are moved into alignment, and the cycle starts again.

According to one or more aspects of the present disclosure, the cycle time for installing tubular joints is advantageously shortened without sacrificing safety, or while more safely handling tubular joints. For example, elevation of the tubular joint may be done concurrently with the lowering of the top drive. For example, the one or more steps associated with removing a support plate that is conventionally used before a tubular joint is joined with a tubular string is no longer necessary. For example, a stabbing guide for ensuring that the tubular joint is properly joined with the tubular string may be installed concurrently with the tubular joint being elevated. According to one or more aspects of the present disclosure, safety around an elevator, CRT, and/or top drive is advantageously improved by eliminating the presence of hands-on human operators doing manual operations. According to one or more aspects of the present disclosure, reliability is advantageously increased due to better control of tubular entry into CRT gripper chamber. According to one or more aspects of the present disclosure, the structure and relative orientation of one or more components of the elevator advantageously avoids unintended rotation and/or axial displacement of the elevator and/or CRT when the elevator doors are opened by maintaining a center of gravity along a center line of the elevator.

Referring now to FIG. 1, a front view of a top drive system is shown, according to one or more aspects of the present disclosure. Top drive system 100 may be situated in an on-shore or off-shore drilling environment. Top drive system 100 includes a top drive 120 and casing running tool (or CRT) 160. Casing running tool 160 is operably coupled to top drive 120, for example, by counter balancing links 140. Top drive 120 may also be coupled to a proximal portion of CRT 160 such that a rotating head of the top drive 120 is coupled to a rotating component of the CRT 160. A tubular joint elevator (such as tubular joint elevator 300 discussed herein) may be disposed at a distal portion of CRT 160 (not shown in FIG. 1).

Figures 1, 2:
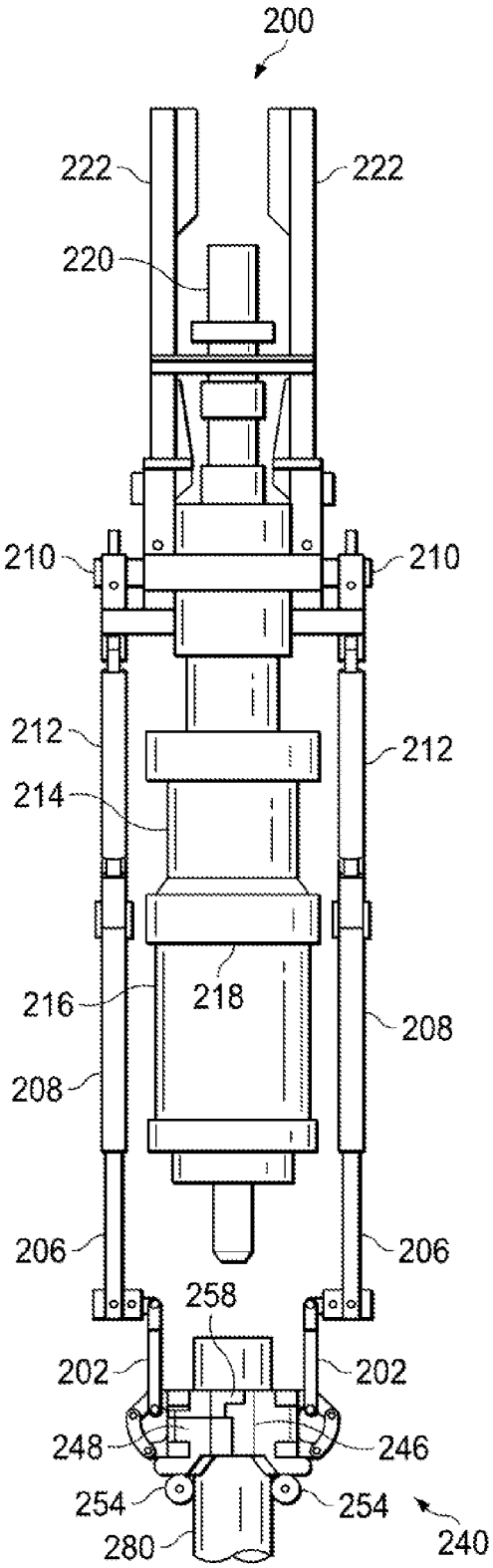
Figure 2:
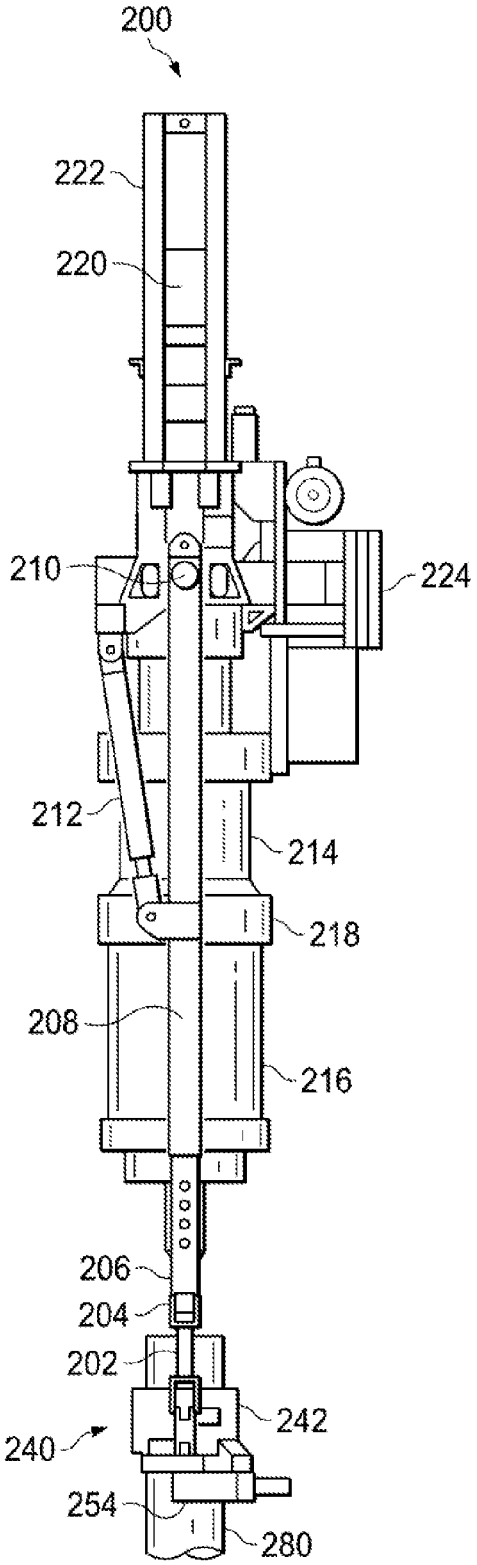
Figures 2, 3:
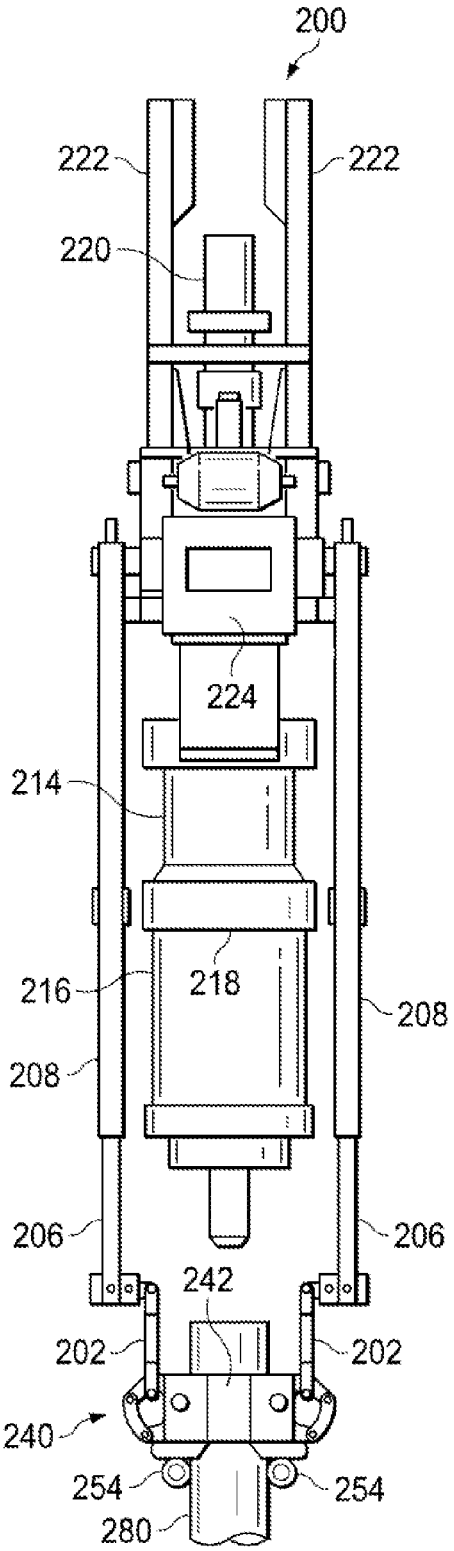
Figures 1, 3:
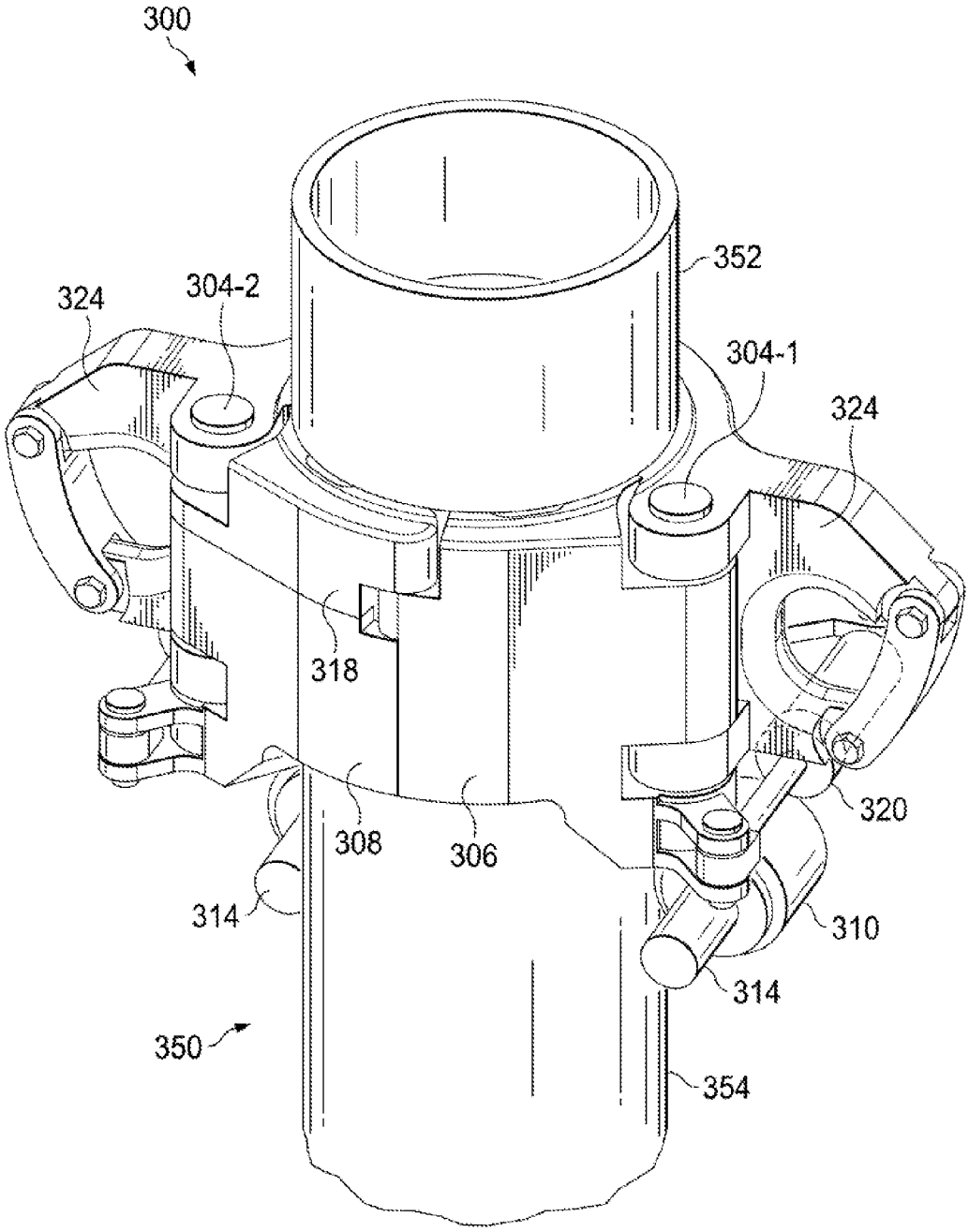
Figures 2, 3:
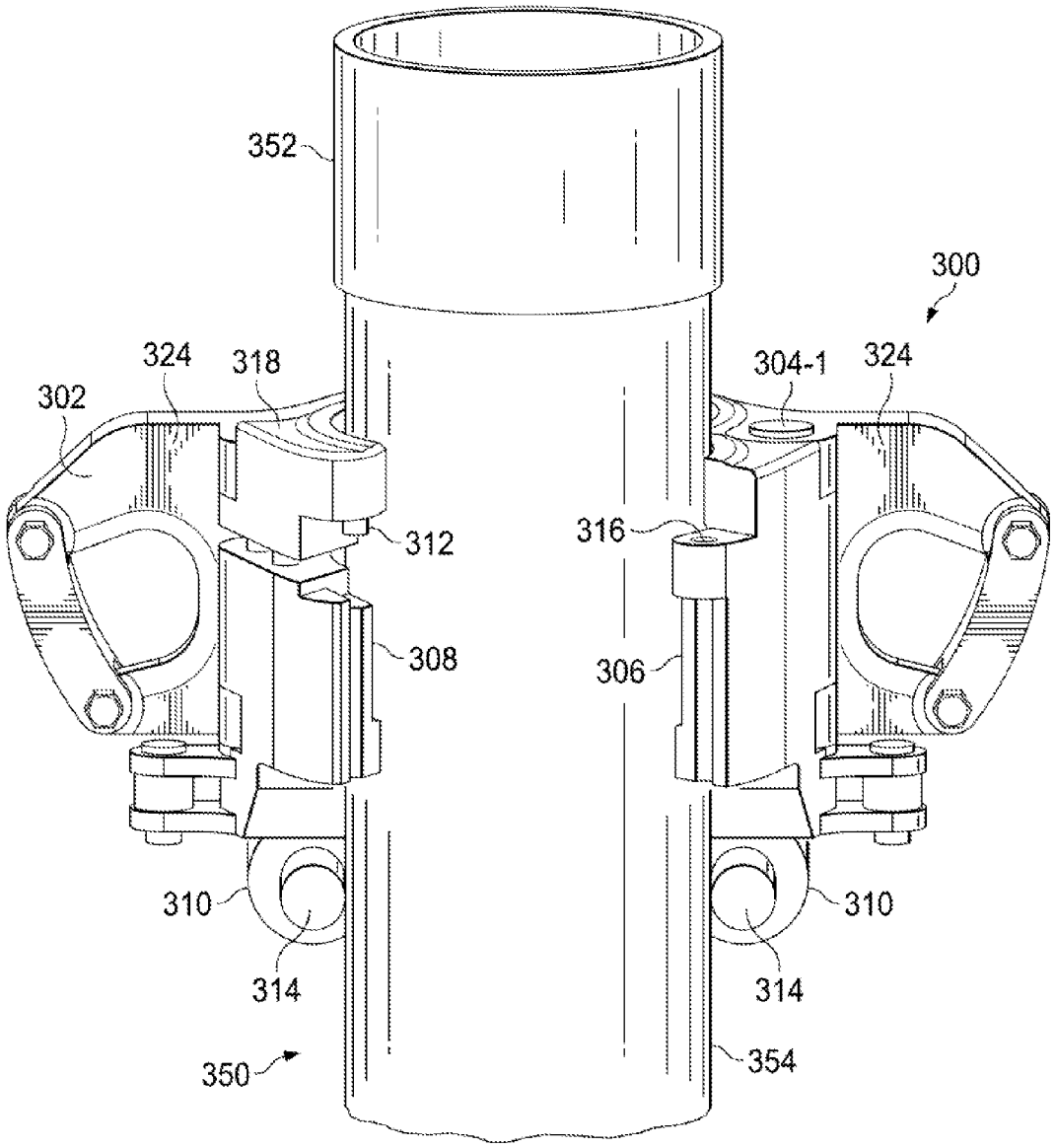
Figure 3:
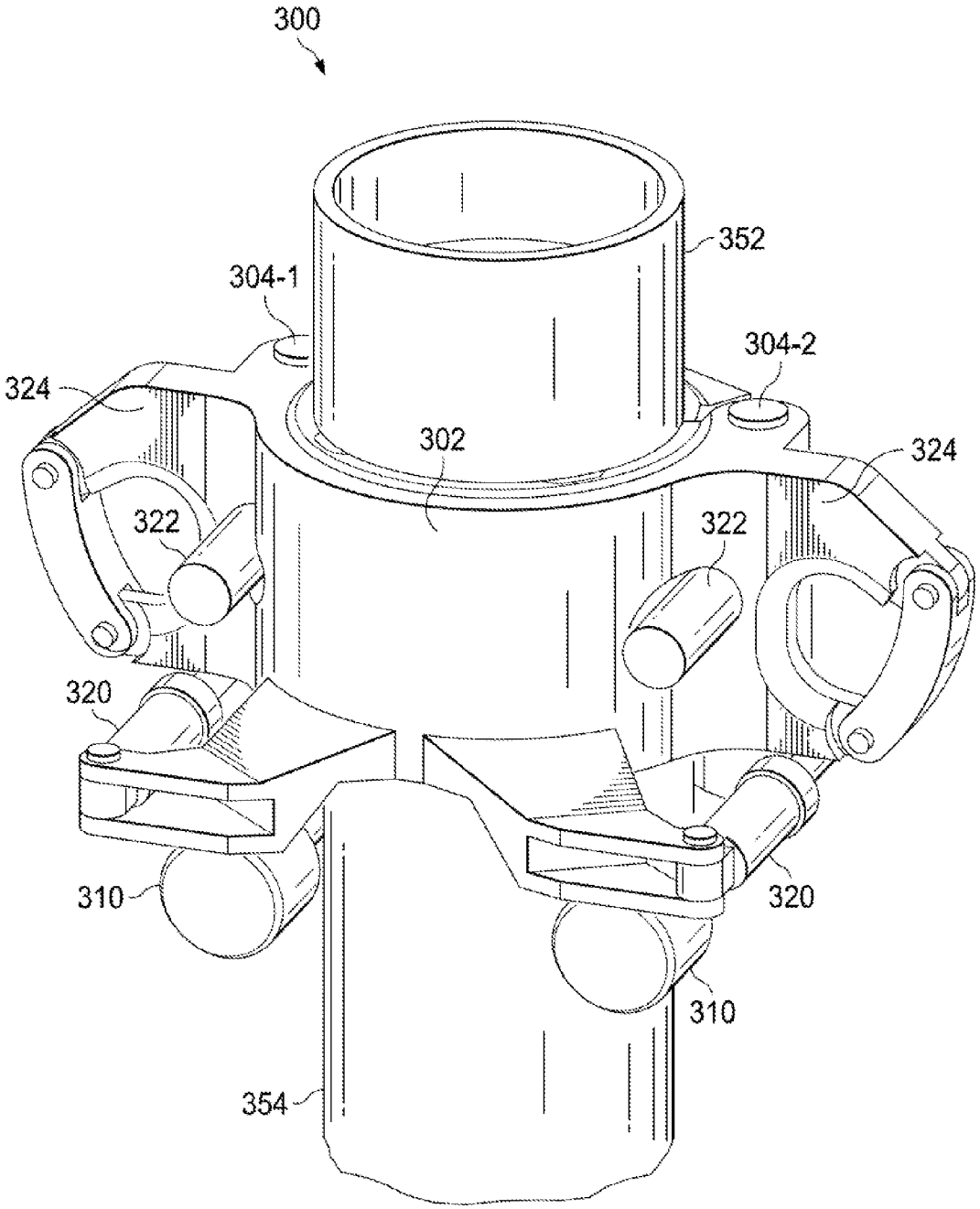

The discussion below generally refers to FIGS. 2-1, 2-2, 2-3. FIG. 2-1 is a back view of a casing running tool 200 and joint elevator 240, according to one or more aspects of the present disclosure. FIG. 2-2 is a side view of the casing running tool and joint elevator of FIG. 2-1, according to one or more aspects of the present disclosure. FIG. 2-3 is a front view of the casing running tool and joint elevator of FIG. 2-1, according to one or more aspects of the present disclosure.

Casing running tool (or CRT) 200 includes an upper assembly 214 and gripper 216. Gripper 216 includes a portion at its distal end to receive, grip, rotate, and/or release a tubular joint 280. For example, gripper 216 may grip and hold tubular joint 280 when tubular joint 280 is being joined to a tubular string. In some embodiments, gripper 216 may be sized to work with a particular size of tubular joint (e.g., a particular diameter). In other embodiments, gripper 216 may work with a variety of sizes of tubular joint. Upper assembly 214 includes one or more components associated with operation of gripper 216, including, e.g., motors, gears, pumps, actuators, etc., adapted to receive, grip, rotate, and/or release tubular joint 280. Upper assembly 214 and gripper 216 may be joined by split ring 218 as shown, or when otherwise connected may be joined by any suitable connector. In the depicted embodiment, CRT 200 includes torque monitoring device 220, which monitors rotational forces being exerted on tubular joint 280 by CRT 200 and/or top drive 120, or any other rotational forces such as a rotary table or supplemental torque-imparting device (not shown) below the CRT 200.

CRT 200 may include one or more upper link tilts 208 and lower link tilts 206. Typically, two or three upper link tilts 208 and lower link tilts are used 206. Upper link tilts 208 may pivot radially about link tilt pivot 210. In some embodiments, upper link tilts 208 may pivot forwards and backwards (e.g., in both directions beyond a center line where upper link tilts 208 are parallel with upper assembly 214 and gripper 216). In other embodiments, upper link tilts 208 only pivot either forwards and backwards (i.e., in only one direction beyond the center line where upper link tilts 208 are parallel with upper assembly 214 and gripper 216). Lower link tilts 206 are typically coupled to upper link tilts 208. In some embodiments, lower link tilts 206 extend from upper link tilts 208. For example, lower link tilts 206 may be received in a recess of upper link tilts 208, and may be selectively extended and retracted to lengthen and shorten the total length of the upper link tilts 208 and lower link tilts 206. Lower link tilt 206 may be extended or retracted so that elevator 240 may be properly aligned with tubular joint 280 when retrieving tubular joint 280 from, e.g., the rig floor. CRT 200 includes link tilt cylinders 212 in the embodiment shown in FIG. 2-1. Link tilt cylinders 212 may each include one or more components associated with the extending and retracting lower link tilts 210 and/or pivoting upper link tilts 208 about link tilt pivot 210. For example, link tilt cylinder 212 may be a hydraulic cylinder. CRT 200 includes brackets 222. Brackets 222 may function to inhibit unintended rotation of CRT 200 as a whole about its longitudinal axis (as opposed to intended rotation of one or more components of CRT 200, which may rotate along with a tubular joint).

CRT 200 may include links adjusting shaft 204. Links adjusting shaft 204 may include one or more components associated with coupling an attachment mechanism (e.g., elevator suspending links 202, for elevator 240) to the distal portion of lower link tilts 206. CRT 200 as shown includes elevator suspending links 202. Elevator suspending links 202 each include one or more components associated with coupling an attachment (e.g., elevator 240) to the distal portion of the lower link tilts 206. Elevator suspending links 202 may each include an attachment mechanism at its distal portion to couple elevator 240 to lower link tilts 206. For example, an attachment member of elevator suspending links 202 may be received through shoulder portions of elevator 240.

Elevator 240 is disposed at a distal portion of CRT 200. Elevator 240 is shown gripping tubular joint 280. Elevator 240 includes main body 242. Main body 242 may be described as a fixed part of elevator 240. As shown in FIG. 2-1, elevator 240 includes first door or right door 246, second door or lower left door 248, and third door or upper left door 258. First door 246, second door 248, and third door 258 are rotatable parts in various embodiments. Elevator 240 includes an elevating mechanism for elevating a tubular joint. The elevating mechanism is configured to independently raise and/or lower the tubular joint (e.g., independent of the motion of elevator 240 as a whole). In one embodiment, the elevating mechanism includes a plurality of rollers 254. In some embodiments, the plurality of rollers 254 are directly opposed to each other to receive a tubular joint 280. Although not shown, a ring of rollers 254 may be disposed in circular configuration to receive a tubular joint 280, although any number of gaps may be included between various rollers. In other embodiments, the elevating mechanism includes, e.g., one or a plurality of claws, clamps or other elements that grip and/or engage the tubular joint. The claws, clamps, and/or other elements may be configured to provide linear motion to a tubular string via cylinders, linear motors, etc., so that the tubular string may be elevated to, e.g., a required height for a CRT gripper to engage the tubular string. According to an exemplary embodiment, a control mechanism may be provided to control one or more components of elevator 240 from a location remote from elevator 240, CRT 200, and/or a top drive. In an exemplary embodiment, the linear motion imparted is in a longitudinal direction along the length of the tubular, such as towards or away from an associated top drive.

The discussion below generally refers to FIGS. 3-1, 3-2, 3-3. FIG. 3-1 is a back view of an elevator 300 gripping a tubular joint 350, according to one or more aspects of the present disclosure. FIG. 3-2 is a back view of the elevator of FIG. 3-1 closing around a tubular joint, according to one or more aspects of the present disclosure. FIG. 3-3 is a front view of the elevator of FIG. 3-1, according to one or more aspects of the present disclosure.

Elevator 300 includes main body 302 (FIG. 3-3). Main body 302 may be described as a fixed part of elevator 300. In some embodiments, main body 302 makes up approximately forty to sixty percent, and in one embodiment about fifty percent, of the circumference of the ringed portion of elevator 300. For example, elevator 300 includes shoulders 324. (An attachment member of elevator suspending links 202 may be received laterally through recesses in shoulders 324 so that elevator 300 is coupled to CRT 200.) Shoulders 324 may be disposed on opposite sides of the circumference of elevator 300. A portion of the circumference on one side of shoulders 324 may include main body 302. In some embodiments, main body 302 includes shoulders 324. A portion of the circumference on the other side of shoulders 324 may include first door or right door 306, second door or lower left door 308, and third door or upper left door 318. Collectively, first door 306, second door 308, and third door 318 may be referred to as rotatable parts of elevator 300. First door 306 may rotate or be displaced radially about door mounting pin 304-1, to open and close. Second door 308 and third door 318 may rotate or be displaced radially about door mounting pin 304-2, to open and close. In some embodiments, second door 308 and third door 318 are coupled during radial displacement and are configured to open and close together (i.e., radial displacement of one causes radial displacement of the other). Elevator 300 includes actuators 320, which may cause the radial displacement of first door 306, second door 308, and/or third door 318. Actuators 320 may be any type of actuator to function as described herein (including, but not limited to, hydraulic, electric, etc.). First door 306, second door 308, third door 318, and/or actuators 320 may be operably coupled to a control mechanism that allows for their control at a location remote from elevator 300, the CRT, and/or the top drive. The ringed portion of elevator 300 may be configured to be enclosed around, grip, and/or lift a tubular joint.

According to an exemplary embodiment, first door 306 has a larger surface area than second door 308, which has a larger surface area than third door 318. In other embodiments, second door 308 and third door 318 may have approximately equal surface areas. In various embodiments, elevator 300 may include first door 306, second door 308, and third door 318 in different positions relative to each other. For example, while FIGS. 3-1, 3-2, 3-3, and others show third door 318 disposed over second door 308, in other embodiments, second door 308 may be disposed over third door 318. As another example, while FIGS. 3-1, 3-2, 3-3 show first door 306 disposed on a right side while second door 308 and third door 318 are disposed on a left, in other embodiments, first door 306 may be disposed on a left side while second door 308 and third door 318 are disposed on a right side. ("Right" and "left," as used herein, are in reference to a back view of elevator 300, such as that shown in FIG. 3-1.) Doors 306, 308, 318 may be configured to close around a second portion 354 of tubular joint 350, below a first or collar portion 352 of tubular joint 350. First portion 352 may be a portion that is coupled to adjoining tubular joint (e.g., the end of a tubular string). In some embodiments, first portion 352 may be disposed on both ends of tubular joint 350. Second portion 354 may include a body of tubular joint 350 below or between first portion(s) 352.

Elevator 300 includes an elevating mechanism. The elevating mechanism is configured to raise and/or lower a tubular joint while elevator 300 stays in the same vertical position (e.g., the elevating mechanism is independent of any vertical movement of the elevator 300). In one embodiment, the elevating mechanism includes rollers 314. Rollers 314 are configured to be displaced radially such that in an advanced or first position, they are adjacent to and contact tubular joint 350 (see, e.g., FIG. 6-2). Rollers 314 may rotate in a direction to cause tubular joint 350 to be displaced upwards (e.g., away from a rig floor). That is, as rollers 314 rotate, tubular joint 350 is elevated or lowered. According to an exemplary embodiment, rollers 314 are locked to rotate only in one direction. Thus, advantageously elevator 300 is configured such that, e.g., a malfunction would not cause tubular joint 350 to be displaced downwards or descend because rollers 314 would be locked in a direction of rotation that only allows upward displacement or elevation of tubular joint 350. In another embodiment, the rollers 314 are locked to rotate only in unison, so that the tubular is never lifted at an angle. In a retracted or second position, rollers 314 are separated from and do not contact tubular joint 354 (see, e.g., FIG. 6-1). Rollers 314 may be in a retracted or second position, among other times, when elevator 300 is being aligned with a tubular joint and before elevator 300 grips tubular joint 354, and again after the associated CRT has gripped an upper end of a tubular joint 354 that has been displaced upwards for the CRT to be in a position to grip the tubular joint 354. Rollers 314 may be in an advanced or first position, among other times, when elevator 300 has gripped tubular joint 354 and before gripper 216 (FIGS. 2-1, 2-2, 2-3) has received tubular joint 354. Elevator 300 includes motor 310, which may cause the radial displacement of rollers 314 into and out of contact with tubular joint 354 and/or the rotation of rollers 314. In some embodiments, multiple motors 310 may be provided to cause the radial displacement and rotation of rollers 314. Multiple motors 310 may be disposed on elevator 300. Motor(s) 310 may be any type of motor to perform the functions described herein (including, but not limited to, hydraulic, electric, etc.). In other embodiment, elevator 300's elevating mechanism includes one or more claws, clamps, and/or other elements to engage and provide linear motion to a tubular string. Motors 310 may be, e.g., linear motors to elevator tubular string via the claws, clamps, and/or other elements. In some embodiments, a screw mechanism may be provided on elevator 300 and tubular joint 354. For example, tubular joint 354 may include threads on an outward-facing surface thereof and elevator 300 may include opposing threads on an inside surface thereof. The threads on the elevator and tubular joint may engage and allow for upward and/or downward movement of the tubular joint in association with the elevating mechanism. In some embodiments, elevator 300 and/or tubular joint 354 may include a magnetic mechanism for elevating the tubular joint. In some embodiments, rollers 314, motor(s) 310, and/or other elements of the elevating mechanism are operably coupled to a control mechanism that allows for their control at a location remote from elevator 300, the CRT, and/or the top drive.

According to one or more aspects of the present disclosure, elevator 300 includes a locking mechanism configured to maintain elevator 300's grip around tubular joint 354. The locking mechanism advantageously inhibits or prevents, e.g., a malfunction from causing tubular joint 354 to be displaced in an uncontrolled manner, such as tubular joint 354 falling to the rig floor. In some embodiments, the locking mechanism has two stages. In a first stage of the locking mechanism, each locking cylinder 322 may include a locking member that is disposed in a locking recess of first door 306, second door 308, and/or third door 318. Rotation or radial displacement (e.g., opening) of first door 306, second door 308, and/or third door 318 may be mechanically inhibited when a locking member is disposed in a locking recess of the door(s). In some embodiments, one locking cylinder 322 has a locking member that is disposed in a locking recess of first door 306 and another locking cylinder 322 has a locking member that is disposed in a locking recess of second door 308. In such embodiments, the radial displacement of second door 308 and third door 318 may be locked together such that when the locking member prevents radial displacement of second door 308, the radial displacement of third door 318 is also prevented.

In a second stage of the locking mechanism, locking pin 312 of third door 318 is received in locking hole 316 of first door 306. In some embodiments, third door 318 may, in addition to radial displacement (i.e., rotation about door mounting pin 304-2), be displaced longitudinally between a first position and a second position. That is, third door 318 may be raised and lowered relative to second door 308. For example, in FIG. 3-2, third door 318 is in a first position and is raised relative to first door 306 and/or second door 308 such that there is a space along the longitudinal axis of elevator 308 that separates first door 306/second door 308 and third door 318. In FIG. 3-1, third door 318 is in a second position and is lowered relative to first door 306 and/or second door 308 such that there is no space that separates first door 306/second door 308 and third door 318, and such that a contact surface (e.g., lower surface) of the third door 318 is adjacent to and in contact with a contact surface (e.g., upper surface) of second door 308. When third door 318 is lowered relative to second door 308, it is also lowered relative to first door 306 such that locking pin 312 is received in locking hole 316. Thus, in the first position, locking pin 312 is separated from locking hole 316. In the second position, locking hole 316 receives locking pin 312. When locking pin 312 is disposed in locking hole 316, first door 306 and second door 308 are mechanically inhibited or prevented from rotating or being radially displaced (i.e., opening). In embodiments in which second door 308 and third door 318 are locked in radial displacement, when second door 308 is inhibited from radial displacement, third door 318 is similarly inhibited.

Figures 1, 4:
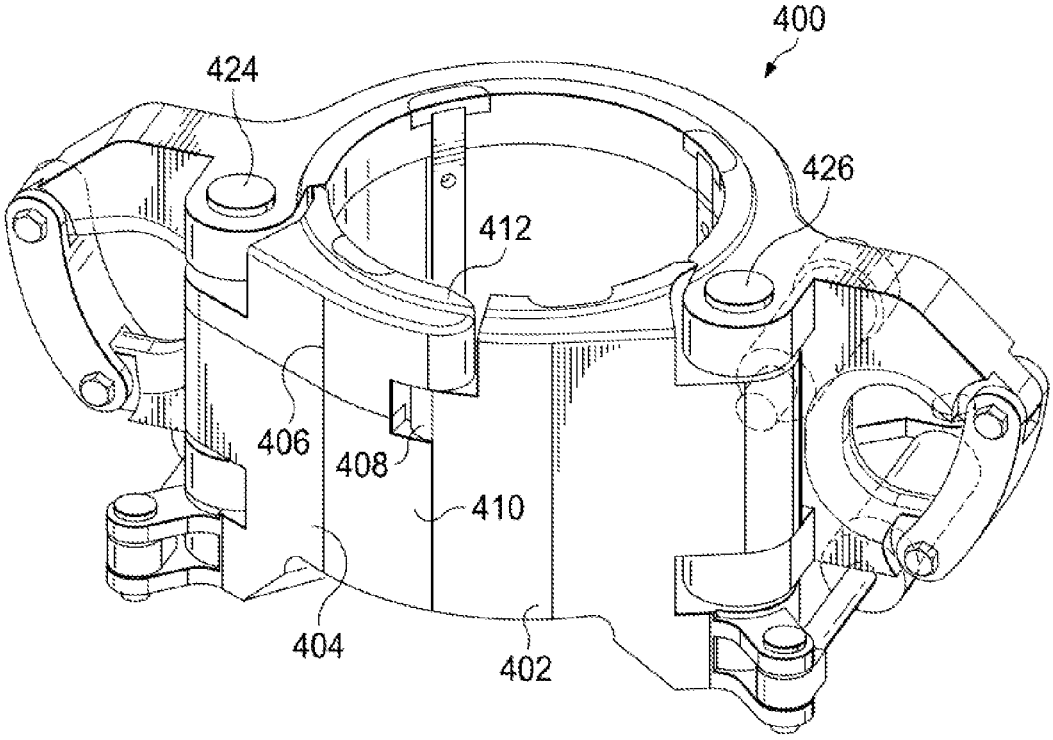
Figures 2, 4:
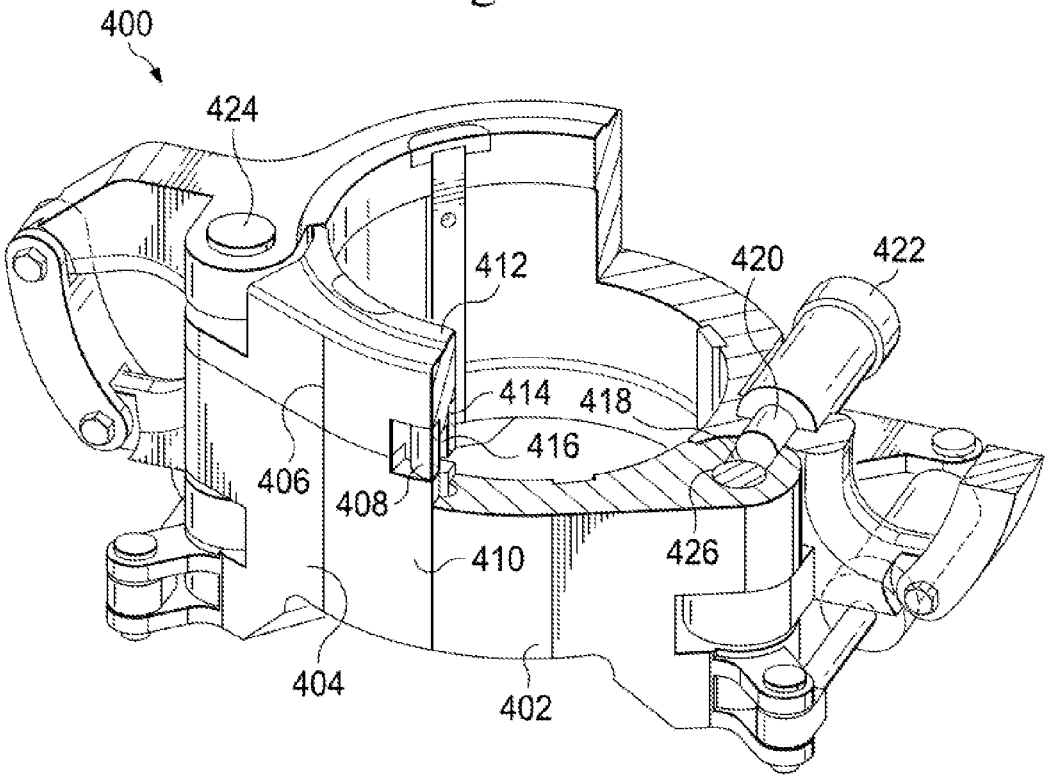
Figures 3, 4:
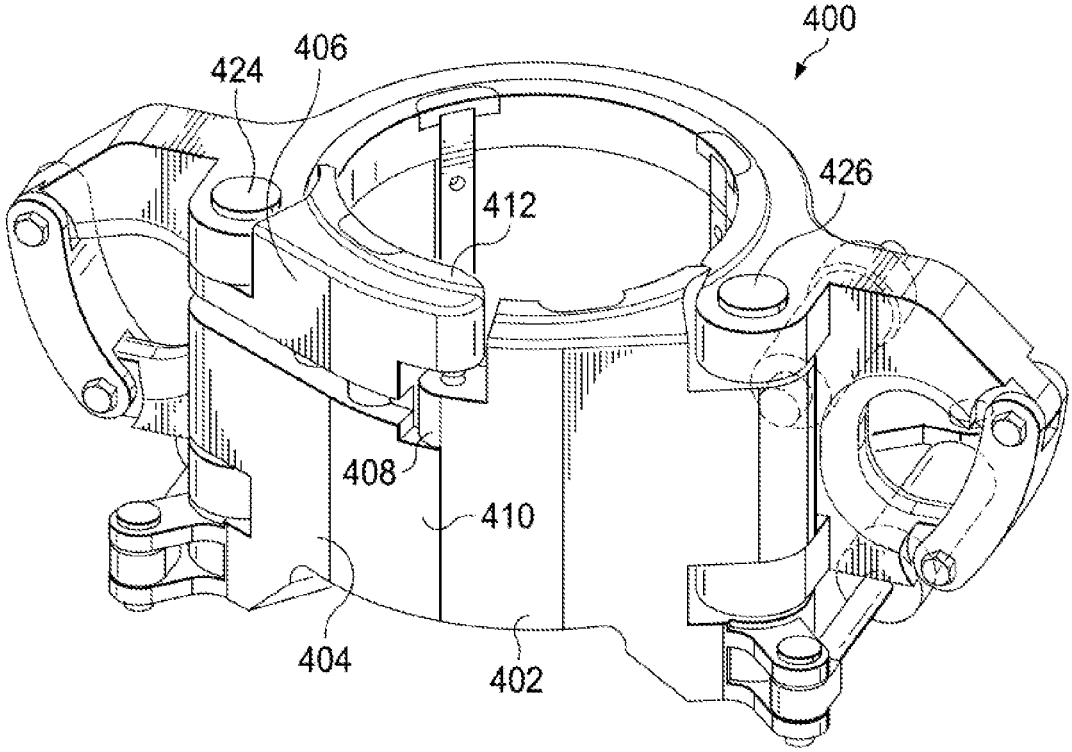
Figure 4:
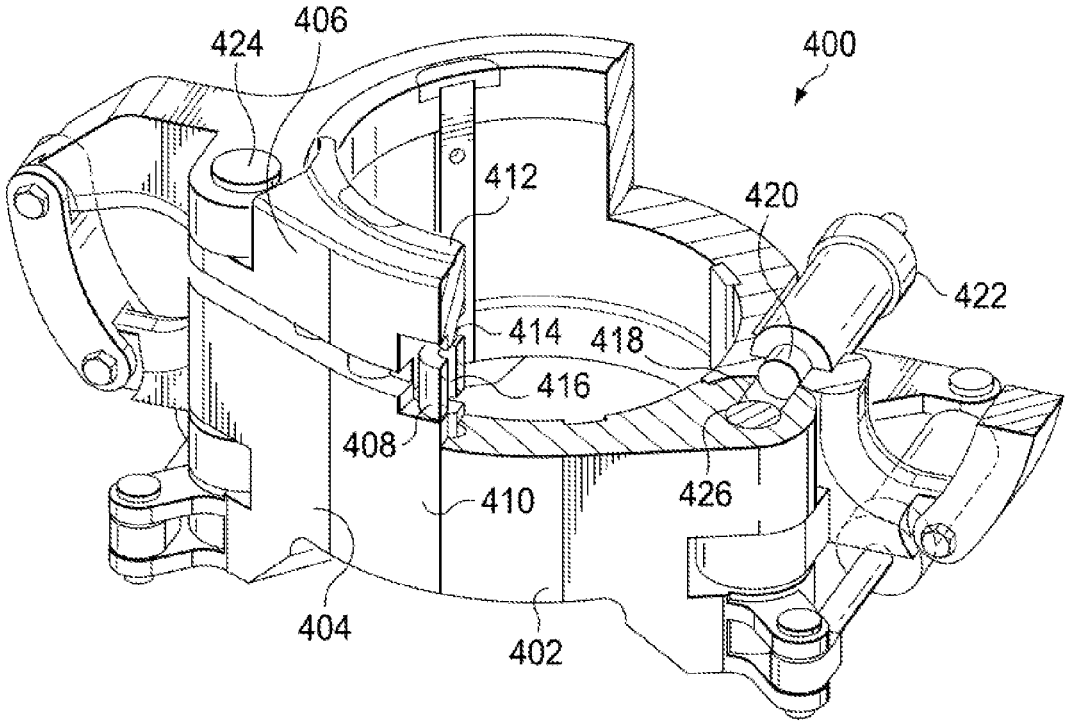
Figures 4, 5:
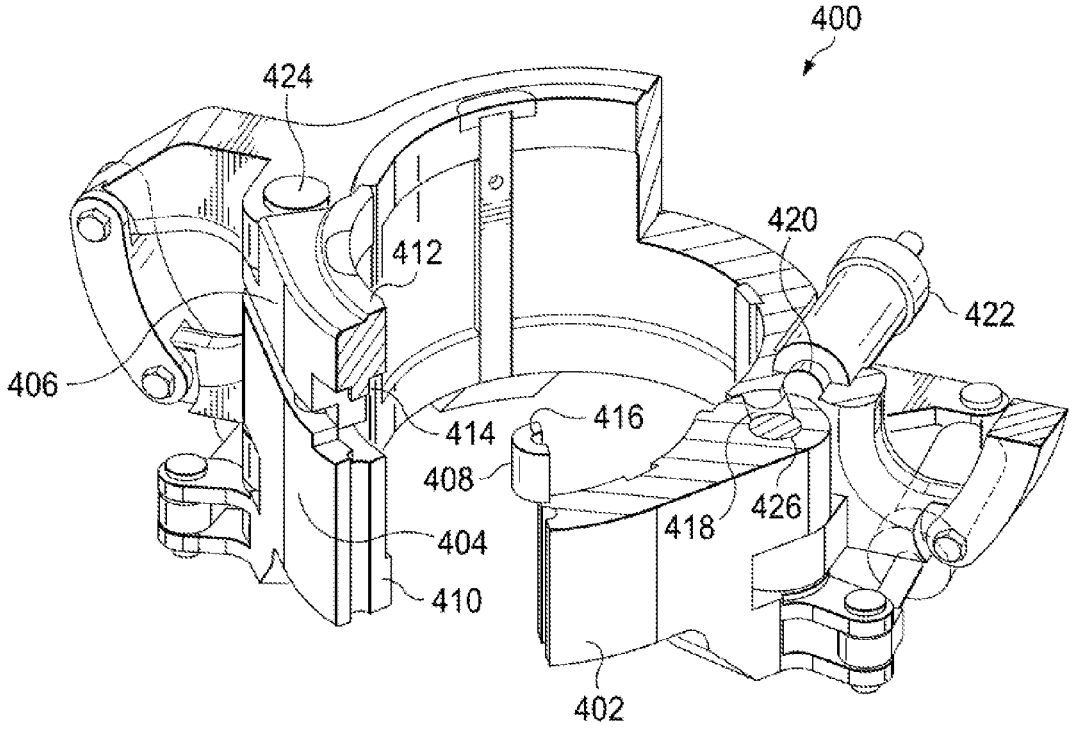
Figure 5:
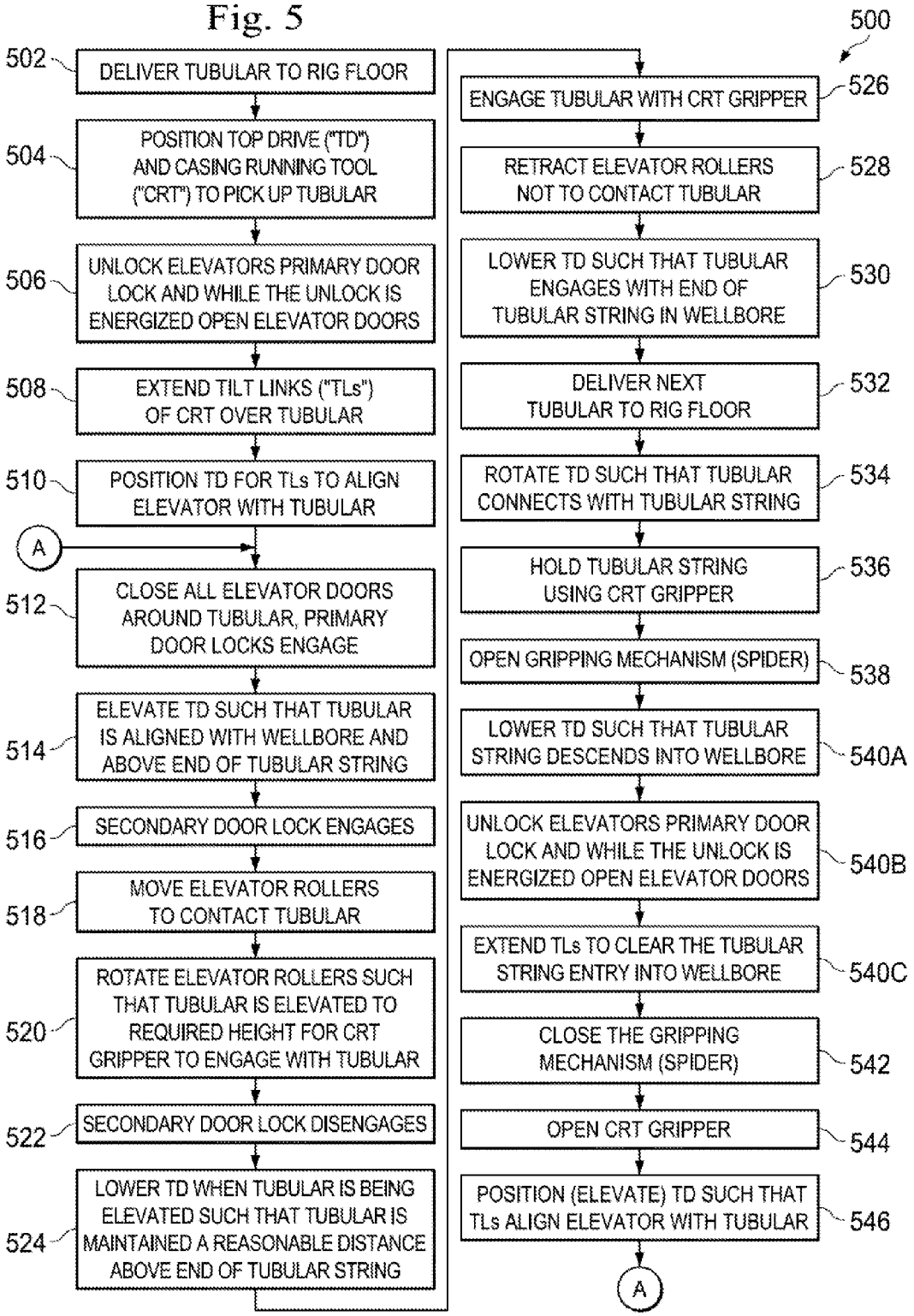

The discussion below generally refers to FIGS. 4-1, 4-2, 4-3, 4-4, 4-5. FIG. 4-1 is a back view of a closed elevator, according to one or more aspects of the present disclosure. FIG. 4-2 is a partial cutaway of the closed elevator of FIG. 4-1, according to one or more aspects of the present disclosure. FIG. 4-3 is an elevator as it is preparing to open, according to one or more aspects of the present disclosure. FIG. 4-4 is a partial cutaway of the elevator of FIG. 4-3, according to one or more aspects of the present disclosure. FIG. 4-5 is a partial cutaway of the back of an elevator as it is opening, according to one or more aspects of the present disclosure. It is understood that elevator 400 of FIGS. 4-1 through 4-5 may include an elevating mechanism (e.g., rollers 314 of FIGS. 3-1, 3-2, and/or any other element configured to provide linear motion to a tubular joint.) One or more aspects of an elevator may be described in U.S. application Ser. No. 11/738,053, filed Apr. 20, 2007, which is incorporated herein by express reference thereto in its entirety.

Referring to FIGS. 4-1 and 4-2, first door 402, second door 404, and third door 406 are shown to be disposed proximate to each other such that a circumference of elevator 400 is generally formed. A plurality of surfaces of first door 402 are in contact with surfaces of second door 404 and third door 406. A contact surface of second door 404 is in contact with a contact surface of third door 406. The first stage and the second stage of the locking mechanism of elevator 400 are also shown engaged. In the first stage, locking member 420 of locking cylinder 422 is received in locking recess 418 of first door 402. In some embodiments, locking cylinder 422 may be spring-loaded mechanism; in other embodiments, locking member 420 may be actuated between an advanced position and a retracted position by any suitable mechanism. When locking member 420 is disposed in locking recess 418, first door is prevented from being radially displaced (i.e., rotated about door mounting pin 426) to help ensure it remains closed. (According to an exemplary embodiment, similar structures are disposed proximate to second door 404, but are not shown in cutaway.) In the second-stage, locking pin 414 of third door 406 is received in locking hole 416 of first door 402. Locking pin 414 may be integrally formed with or otherwise coupled to third door 406 and extend axially therefrom. Locking hole 416 is disposed in a portion 408 integrally formed with or otherwise coupled to first door 402 and extending thereform. According to an exemplary embodiment, portion 408 is disposed between portion 412 and portion 410 of second door 404.

According to an exemplary embodiment, the structure and relative orientation of door 402, 404, 406 advantageously avoids unintended rotational and/or axial displacement of the elevator 400 and CRT by maintaining a center of gravity along a center line of the elevator 400. The center line may be an imaginary line extending from a location of elevator 400 where doors 402, 404, 406 meet and join to close, through the center of the elevator (where a tubular joint would be), and to the front (e.g., the main body) of the elevator 400. For example, the center line may connect longitudinal portions of FIG. 4-2, where the cutaway is shown on doors 402, 404, 406 and on the front of elevator 400. In some embodiments, a center of gravity may be maintained as a result of a balanced weight distribution between doors 402, 404, 406 such that as doors 402, 404, 406 are opened and/or closed, balance is maintained on the left and ride side of the elevator. Overlapping portions of doors 402, 404, 406 (e.g., portion 412 overlaps door 402, portion 408 overlaps door 404, 406, portion 410 overlaps door 402, etc.) may allow for the balance in weight on either side of elevator 400 to be maintained. A center of gravity of elevator 400 may be maintained as the doors 402, 404, 406 are opening by positioning doors 402, 404, 406 substantially within a circumference defined by elevator 400 with closed doors. For example, doors 402, 404, 406 may rotate upwards and/or downwards as the doors are opening. A hydraulic or other suitable mechanism for rotating the doors upwards may be provided on elevator 400 to allow for and to counteract such movement. Thus, as they are opening, the doors do not extend a greater lateral extent beyond a circumference defined by elevator 400 with closed doors (e.g., when elevator 400 is viewed from a top-down perspective). This may advantageously prevent elevator 400 from unintentionally tilting or rotating in the lateral direction that the doors extend when opening. In other embodiments, doors 402, 404, 406 and/or elevator 400 are mechanically constrained from unintentionally tilting or rotating in multiple directions. For example, a post to which the doors and/or elevator are coupled may be positioned behind an axis at which doors and/or elevator tilt. Because the doors and/or elevator are coupled to the post, the doors and/or elevator are mechanically constrained from tilting while being able to rotate sufficiently to open and close about the tubular.

Referring to FIGS. 4-3 and 4-4, second door 404 is separated from third door 406, and fewer surfaces of first door 402 are in contact with surfaces of third door 406 as elevator 400 prepares to open. Third door 406 is shown to be longitudinally displaced (i.e., raised) relative to second door 404 and portion 408 of first door 402. The second stage of the locking mechanism is thus not engaged. As shown in FIG. 4-4, locking pin 414 of third door 406 is not received in locking hole 416 of first door 402. The first stage of the locking mechanism is also not engaged. Locking member 420 is in a retracted position such that it is separated from locking recess 418 of first door 402. (According to an exemplary embodiment, similar structures are disposed proximate to second door 404, but are not shown in cutaway.) With one or both stages of locking mechanism not engaged, doors 402, 404, and 406 may be radially displaced (i.e., rotated about door mounting pins 426, 424, respectively).

Referring to FIG. 4-5, a circumference of elevator 400 is no longer closed because doors 402, 404, 406 are opening or opened. When doors 402, 404, 406 are opened, a tubular joint may be received in elevator 400. Doors 402, 404, 406 may open because any stages of the locking mechanism in use are not engaged. With respect to the first stage, locking member 420 of locking cylinder 422 is not disposed in locking recess 418 of first door 402. Indeed, locking recess 418 is shown to be radially displaced relative to locking member 420. (According to an exemplary embodiment, similar structures are disposed proximate to second door 404, but are not shown in cutaway.) With respect to the second stage, locking pin 414 of third door 406 is not disposed in locking hole 416 of first door 402. First door 402 is shown to be rotating about door mounting pin 426. Second door 404 and third door 406 are shown to be rotating about door mounting pin 424.

Figures 1, 6:
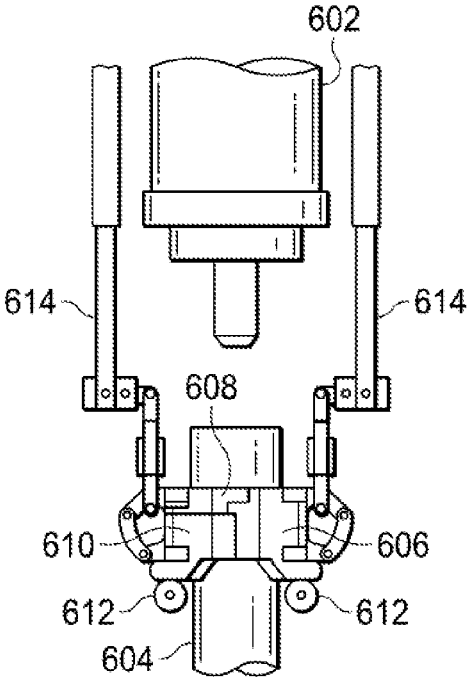
Figures 2, 6:
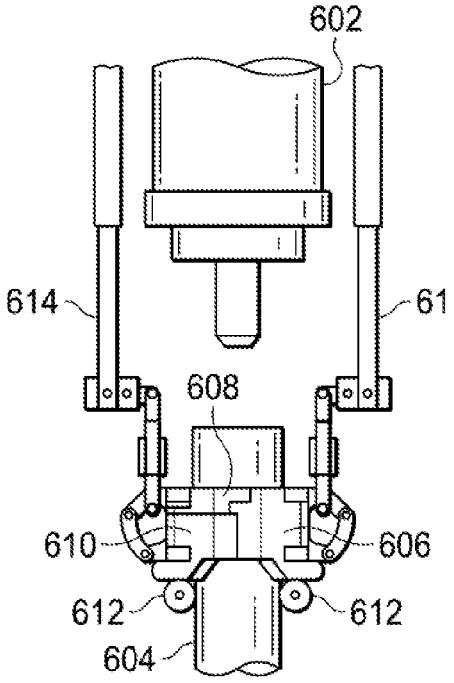
Figures 3, 6:
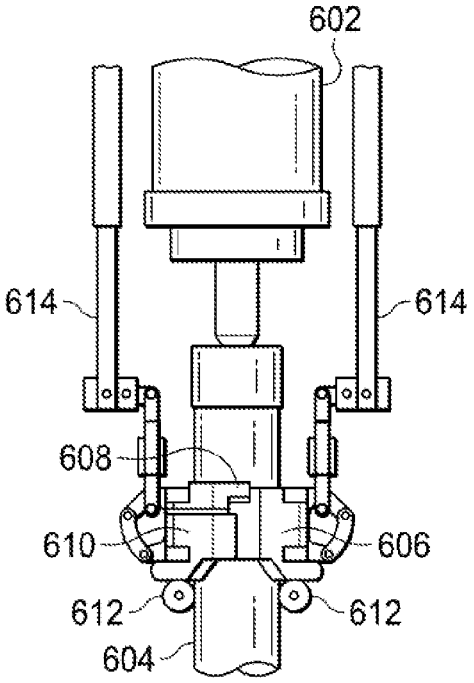
Figures 4, 6:
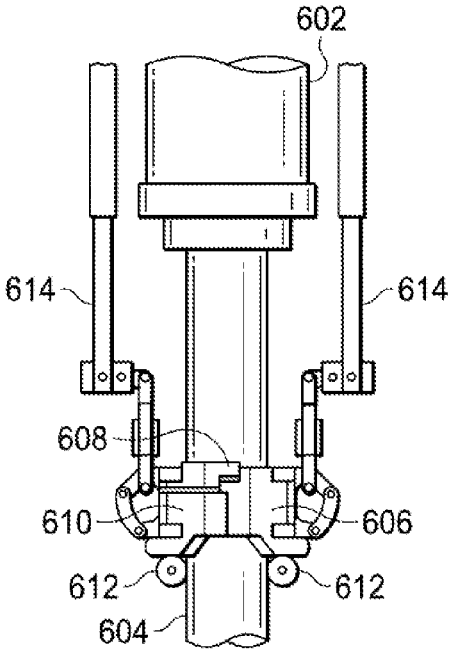
Figures 5, 6:
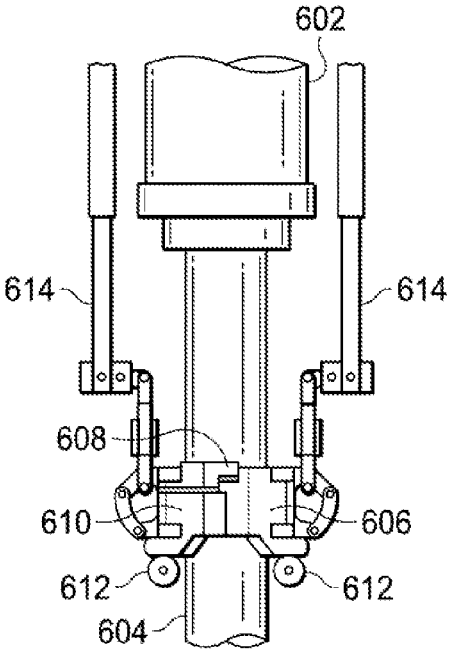

The discussion below generally refers to FIGS. 5, 6-1, 6-2, 6-3, 6-4, and 6-5. FIG. 5 is a flow diagram of a process for assembling a tubular string at least partially disposed in a wellbore, according to one or more aspects of the present disclosure. FIG. 6-1 shows a back view of an elevator gripping a tubular joint, according to one or more aspects of the present disclosure. FIG. 6-2 shows an elevating mechanism (e.g., rollers) of the elevator of FIG. 6-1 contacting a tubular joint, according to one or more aspects of the present disclosure. FIG. 6-3 shows the elevating mechanism of FIG. 6-2 elevating a tubular joint towards a component of a casing running tool, according to one or more aspects of the present disclosure. FIG. 6-4 shows a tubular joint engaging with the component of the casing running tool of FIG. 6-3, according to one or more aspects of the present disclosure. FIG. 6-5 shows the elevating mechanism of FIG. 6-2 retracted from a tubular joint, according to one or more aspects of the present disclosure.

Referring to FIG. 5, process 500 includes delivering a tubular joint to or adjacent to, a work area, e.g., a rig floor (502). For example, it may be delivered to the rig's v-door. A top drive and a casing running tool ("CRT") are positioned to pick up the tubular joint (504). The top drive and CRT may be similar to those discussed herein. According to an exemplary embodiment, the CRT is mounted at a distal portion of the top drive. The top drive and CRT may be positioned by moving, e.g., a traveling block to which the top drive is coupled. For example, the top drive and CRT may be raised, lowered, or otherwise positioned to pick up the tubular joint. The CRT may be aligned with the tubular joint. The elevator's primary door lock(s) (e.g., the first stage of the locking mechanism) are unlocked and, while the unlock is energized, the elevator doors may be opened (506). The elevator doors may include the first door, second door, and third door discussed herein. The elevator doors may be opened to receive a tubular joint within its circumference. Opening the elevator doors may include activating actuators configured to radially displace one or more of the doors. The unlock being energized may refer to the activation of locking cylinders to axially displace a locking member and remove the locking member from a locking recess discussed herein. The doors may be opened by activating the actuators because the primary door lock(s) is unlocked. Tilt links ("TLs") of CRT extend over a tubular joint (508). The tilt links may be similar to upper tilt links and lower tilt links discussed herein. The TLs may be mounted to the stationary body of the CRT. The stationary body of the CRT may include one or more components discussed herein, such as the upper assembly and the gripper. An elevator may be mounted at the lower portion of the TLs. The elevator may be similar to the tubular joint elevator discussed herein. The elevator may have its doors opened and rollers retracted, allowing the elevator to close on the tubular joint. The rollers may be similar to the rollers discussed herein. While rollers are specifically mentioned in FIG. 5, in other embodiments, different elements (e.g., claws, clamps, etc.) may be used for the elevating mechanism. These elements may or may not need to be retracted to allow the elevator to close the tubular joint. It is within the scope of this disclosure for any one or more elements of the elevating mechanism to move as required for the elevator to open and then close on a tubular joint. The top drive may be positioned for TLs to align the elevator with the tubular joint (510). The position of the top drive and CRT and/or the position of the TLs may be adjusted, and that movement may stop when the elevator is aligned with the tubular joint.

The elevator doors are closed around the tubular joint, and the primary door lock(s) engage (512). For example, a first door, second door, and third door may be closed around the tubular joint. The third door may be spaced apart from second door. According to an exemplary embodiment, the doors may be moved by actuators 320 (e.g., by activating hydraulically operated actuators). The primary door lock may be the first stage of a locking mechanism discussed herein. The primary door locking engaging may refer to the activation of locking cylinders to axially displace the locking member so that the locking member is received in the locking recess of the first door and/or the second door. In some embodiments, a locking member may be energized by a spring in the locking cylinder. According to an exemplary embodiment, with the first stage of the locking mechanism engaged, the elevator doors cannot be opened by activating the actuators.

The top drive may be elevated such that the tubular joint is aligned with a wellbore and above the end of a tubular string (514). The tubular string may be at least partially disposed in the wellbore. It should be understood that the tubular joint may be the first or last portion of the tubular string, or that the tubular joint is going to being attached to or broken out from the rest of the tubular string. The top drive may be elevated when the traveling block, to which the top drive is coupled, is elevated. The secondary door lock engages (516). The secondary door lock may be the second stage of the locking mechanism discussed herein. The third door may be longitudinally displaced (e.g., towards the second door) such that the locking pin of the third door engages the locking hole of the first door. According to an exemplary embodiment, the secondary door lock is engaged when the weight of the collar or first area of tubular joint, discussed herein, rests along the circumference of the elevator. According to an exemplary embodiment, with both stages of the lock engaged, the doors of the elevator cannot be opened in any way. This is shown, for example, in FIG. 6-1. Tubular joint 604 is enclosed by the elevator. The elevator is coupled to lower tilt links 614. First door 606, second door 610, and third door 608 are closed, and proximate to and in contact with one another. Second door 610 and third door 608 are not separated, and thus a locking pin of third door 608 is received in a locking hole of first door 606. Rollers 612 are separated from tubular joint 604.

Referring back to FIG. 5, the elevator rollers are moved to contact the tubular joint (518). The rollers may be radially moved towards the tubular joint. The rollers are similar to those discussed herein. This is shown in FIG. 6-2. Rollers 612 are radially displaced (e.g., inwards) compared to the position of rollers 612 in FIG. 6-1 and contact tubular joint 604. The second locking mechanism remains engaged in that third door 608 and first door 610 are not separated.

Referring back to FIG. 5, to elevate the tubular joint, elevator rollers may be rotated such that the tubular joint is elevated to the required height for CRT gripper to engage with tubular (520). Rollers 612 may rotate while in contact with tubular joint 604 causing tubular joint 604 to be elevated towards gripper 602 of the casing running tool. In embodiments in which the elevator's elevating mechanism includes elements other than or in addition to rollers (e.g., claws, clamps, etc.), the elements may be configured to move as required to engage a tubular joint and/or cause the tubular joint to be elevated. Using an elevating mechanism to elevate the tubular joint may advantageously avoid the time and human operator involvement associated with placing the tubular joint on a support plate covering the tubular string while the elevator is properly positioned around the tubular joint such that the tubular joint engages with a top drive and/or CRT gripper. This can advantageously avoid one or more of the following steps in a traditional make-up process: lowering a tubular onto the support plate to re-grip it at a different location, then raising it, and then removing the support plate, before continuing with the make-up process. The secondary door lock disengages (522). That is, the third door is longitudinally displaced away from the second door such that there is a space separating them and the locking pin of the third door is separated from the locking hole of the second door. This is shown in FIG. 6-3. The secondary lock is disengaged, as shown by the longitudinal (e.g., upward) displacement of third door 608 relative to first door 606 and/or second door 610. Thus, the locking pin of third door 608 is separated from the locking hole of the first door 606. In some embodiments, the top drive may be lowered when the tubular joint is being elevated such that tubular joint is maintained a reasonable distance above end of tubular string or tubular string (524). For example, the top drive may be lowered as a result of the traveling block, to which the top drive may be coupled, being lowered. In some embodiments the tubular joint may appear to be stationary or to move only slightly when the top drive system (e.g., FIG. 1) is viewed from the perspective of the tubular joint, because the tubular joint is being elevated while the top drive (to which the tubular joint is to be coupled) is being lowered (resulting in, e.g., no net upward or downward movement when viewed from the perspective tubular joint, though, when viewed from the perspective of the tubular string, the elevator and tubular joint are being lowered). In other embodiments, the tubular joint may actually be stationary relative to the tubular string or to an outside observer, as it can be raised by the elevator of the present disclosure in an opposite direction and at an equal rate to a top drive or associated CRT being lowered toward the tubular.

Referring back to FIG. 5, the tubular joint is engaged by the CRT gripper (526). For example, when the fully elevated tubular joint thrusts against a contact plate of the gripper, the gripper closes. The gripper may be similar to that discussed herein. This is shown in FIG. 6-4. Tubular joint 604 is fully elevated in that a portion of the tubular below the collar thereof is engaged by gripper 602. The second locking mechanism is not engaged so third door 608 remains longitudinally separated from first door 606 and/or second door 610.

Referring back to FIG. 5, elevator rollers are retracted so as to not contact the tubular joint (528). That is, the rollers are radially displaced (e.g., outwards) from the tubular joint. For example, a sensor controlling the CRT gripper may send a signal of proper gripper engagement (from step 528). Based on this signal, the rollers retract radially and are spaced apart from the tubular. This is shown in FIG. 6-5. Rollers 612 are separated from tubular joint 604. Tubular joint 604 remains in engagement with gripper 602. Tubular engagement with the gripper and roller separation from tubular joint may allow for CRT gripper to rotate the tubular joint. The second locking mechanism is not engaged so third door 608 remains longitudinally separated from first door 606 and/or second door 610. In embodiments in which the elevator's elevating mechanism does not include rollers or includes other elements, these other elements of the elevating mechanism may be configured to move as required to allow the CRT gripper to act on the tubular joint.

Referring back to FIG. 5, the top drive is lowered such that the tubular joint engages with end of tubular string in well bore (530). That is, the top drive "stabs" the tubular joint into the drill string. In some embodiments, in parallel, a next tubular joint is delivered to the rig floor or v-door (532). In various embodiments, multiple tubular joints may have been delivered to the rig floor initially, either individually or with two or three tubular joints already connected. In other embodiments, the next tubular joint is delivered at earlier or later stages of process 500. The top drive is rotated such that tubular connects with tubular string (534). That is, the top drive may apply torque to the tubular joint to cause engagement of the tubular with the tubular string in the wellbore. For example, the end of the tubular joint engaged by the gripper may be received in the collar portion of a tubular joint at the end of the tubular string. In some embodiments, process 500 includes directly applying torque to the tubular joint to join the tubular joint with the tubular string. For example, torque can be applied directly after elevating the tubular joint using the elevating mechanism.

The tubular string is held using the CRT gripper (536). That is, the CRT gripper remains engaged to the tubular joint, which is now coupled to the rest of the tubular string. A gripping mechanism or spider may be opened (538). The gripping mechanism may be any suitable structure disposed, e.g., on the rig floor, that also grips and/or holds the tubular string. According to an exemplary embodiment, the gripping mechanism is a spider. By opening the gripping mechanism, the tubular string is released so that the tubular string can, e.g., descend into the wellbore. The top drive may be lowered such that tubular string descends into wellbore (540A). The elevator's primary door lock(s) may be unlocked, and, while the unlock is energized, the elevator doors are opened (540B). Unlocking the primary door lock(s) and opening the elevator doors may be substantially similar to step 506. The TLs may be extended to clear the tubular string entry into wellbore (540C). For example, the TLs may be moved or otherwise positioned such that there is no inadvertent contact between the TLs and the tubular string. According to an exemplary embodiment, steps 540A, 540B, and 540C may be completed in parallel or in any order.

The gripping mechanism or spider may be closed (542). Thus, the gripping mechanism may grip and/or hold the tubular string after it has, e.g., descended further into the wellbore. The CRT gripper is opened (544). Opening the CRT gripper may release the tubular string. The top drive may be positioned (e.g., elevated or lowered) such that the TLs align the elevator with the next tubular (546). According to an exemplary embodiment, the next cycle then begins with step 512.

In view of all of the above and the figures, one of ordinary skill in the art will readily recognize that the present disclosure introduces a tubular joint elevator. The tubular joint elevator includes a ringed portion configured to grip and/or lift a tubular joint; and an elevating mechanism disposed adjacent to the ringed portion, and configured to elevate the tubular joint.

In some embodiments, the elevating mechanism comprises a plurality of rollers, the plurality of roller configured to elevate the tubular joint by rotating when in contact therewith. In some embodiments, the plurality of rollers are disposed below the ringed portion. In some embodiments, the plurality of rollers comprise a locking mechanism configured to fix a single direction of rotation thereof. In some embodiments, the ringed portion comprises a fixed part and a plurality of rotatable parts, the plurality of rotatable parts selectively opening to receive the tubular joint and selectively closing to enclose the tubular joint. In some embodiments, the plurality of rotatable parts comprises a first door, a second door, and a third door. In some embodiments, the tubular joint elevator includes a first locking member, and wherein the first door comprises a first locking recess. In some embodiments, the first locking member is axially displaceable between an advanced position and a retracted position, wherein, in the advanced position, the first locking recess receives the first locking member, and, in the retracted position, the first locking member is separated from the first locking recess. In some embodiments, the tubular joint elevator includes a second locking member, and wherein the second door comprises a second locking recess. In some embodiments, the second locking member is axially displaceable between an advanced position and a retracted position, wherein, in the advanced position, the second locking recess receives the second locking member, and, in the retracted position, the second locking member is separated from the second locking recess. In some embodiments, the third door comprises a locking pin and the first door comprises a locking hole. In some embodiments, the third door is longitudinally displaceable between a first position and a second position, wherein, in the first position, the locking pin is separated from the locking hole, and, in the second position, the locking hole receives the locking pin. In some embodiments, one of the second door and the third door is disposed above the other. In some embodiments, the second door and the third door are coupled during radial displacement so that movement of one causes movement of the other. In some embodiments, the tubular joint elevator includes a control mechanism operable from a location remote from the tubular joint elevator, the control mechanism configured to operate at least one of (a) starting and stopping rotation of the elevating mechanism; (b) selective opening and closing of the plurality of rotatable parts; (c) axial displacement of the first locking member; and (d) longitudinal displacement of the third door.

The present disclosure also introduces a tubular joint elevator. The tubular joint elevator includes a ringed portion configured to lift and/or grip a tubular joint, the ringed portion comprising a fixed part and a plurality of rotatable parts, the plurality of rotatable parts selectively opening to receive the tubular joint and selectively closing to enclose the tubular joint; and a plurality of rollers disposed adjacent to the ringed portion, and configured to elevate the tubular joint by rotating when in contact with the tubular joint.

In some embodiments, the plurality of rollers comprise a locking mechanism configured to fix a single direction of rotation thereof. In some embodiments, the plurality of rotatable parts comprises a first door, a second door, and a third door. In some embodiments, the tubular joint elevator includes a plurality of locking members, wherein the first door and the second door each comprise a locking recess, the plurality of locking members being axially displaceable between an advanced position and a retracted position, wherein, in the advanced position, the locking recess receives one of the plurality of locking members, and, in the retracted position, the one of the plurality of locking members is separated from the locking recess. In some embodiments, the third door comprises a locking pin and the first door comprises a locking hole, the third door is being longitudinally displaceable between a first position and a second position, wherein, in the first position, the locking pin is separated from the locking hole, and, in the second position, the locking hole receives the locking pin. In some embodiments, the tubular joint elevator includes a control mechanism operable from a location remote from the tubular joint elevator, the control mechanism configured to operate at least one of (a) starting and stopping rotation of the plurality of rollers; (b) selective opening and closing of the plurality of rotatable parts; (c) axial displacement of the plurality of locking member; or (d) longitudinal displacement of the third door; or a combination thereof.

The present disclosure also introduces a method of extending a tubular string at least partially disposed in a well bore. The method includes providing a tubular joint; gripping the tubular joint using a tubular joint elevator; elevating the tubular joint using an elevating mechanism; and applying torque to the tubular joint to join the tubular joint with the tubular string.

In some embodiments, the elevating mechanism comprises a plurality of rollers, the plurality of rollers elevating the tubular joint by rotating when in contact therewith. In some embodiments, gripping the tubular joint comprises closing a plurality of doors of the tubular joint elevator around the tubular joint. In some embodiments, gripping the tubular joint further comprises activating a locking mechanism to prevent the doors of the tubular joint elevator from opening. In some embodiments, the elevating mechanism is arranged in at least a partially ringed configuration around the tubular joint. In some embodiments, the elevating mechanism forms a ringed configuration sized to receive the tubular joint.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure. While a method including multiple steps is described, it is understood that one or more of the steps may be completed in a different order or in parallel without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112(f) for any limitations of any of the claims herein, except for those in which the claim expressly uses the word "means" together with an associated function.

What is claimed is:

1. A system, comprising:

a tubular joint elevator comprising:

a ringed portion configured to lift a tubular joint, wherein the ringed portion comprises a first door, a second door, and a third door and at least a portion of the second door or third door overlaps the first door, and an elevating mechanism disposed adjacent to the ringed portion, and configured to elevate the tubular joint, wherein the elevating mechanism comprises a plurality of rollers, wherein each of the plurality of rollers comprise a locking mechanism configured to allow rotation of the roller in a single direction; and a casing running tool (CRT) operably associated with the tubular joint elevator and configured to grip an upper end of the tubular joint when the elevating mechanism elevates the tubular joint to a height for the CRT to grip the tubular joint.

2. The system of claim 1, wherein the plurality of rollers are disposed below the ringed portion.

3. The system of claim 1, wherein the ringed portion further comprises a fixed part.

4. The system of claim 1, wherein the tubular joint elevator further comprises a first locking member, and wherein the first door comprises a first locking recess.

5. The system of claim 4, wherein the first locking member is axially displaceable between an advanced position and a retracted position, wherein, in the advanced position, the first locking recess receives the first locking member, and, in the retracted position, the first locking member is separated from the first locking recess.

6. The system of claim 5, wherein the tubular joint elevator further comprises a control mechanism operable from a location remote from the tubular joint elevator, the control mechanism configured to operate at least one of: (a) starting and stopping the elevating mechanism; (b) selective opening and closing of the first door, the second door, and third door; (c) axial displacement of the first locking member; or (d) longitudinal displacement of the third door; or a combination thereof.

7. The system of claim 1, wherein the tubular joint elevator further comprises a second locking member, and wherein the second door comprises a second locking recess.

8. The system of claim 7, wherein the second locking member is axially displaceable between an advanced position and a retracted position, wherein, in the advanced position, the second locking recess receives the second locking member, and, in the retracted position, the second locking member is separated from the second locking recess.

9. The system of claim 1, wherein the third door comprises a locking pin and the first door comprises a locking hole.

10. The system of claim 9, wherein the third door is longitudinally displaceable between a first position and a second position, wherein, in the first position, the locking pin is separated from the locking hole, and, in the second position, the locking hole receives the locking pin.

11. The system of claim 1, wherein one of the second door and the third door is disposed above the other.

12. The system of claim 1, wherein the second door and the third door are coupled during radial displacement so that movement of one causes movement of the other.

13. The system of claim 1, wherein the tubular joint elevator further comprises a control mechanism operable from a location remote from the tubular joint elevator.

14. The system of claim 1, wherein the plurality of rollers are positioned directly opposed to each other to receive the tubular joint.

15. The system of claim 1, wherein the plurality of rollers comprise a first roller configured to rotate in a first direction to elevate the tubular joint and a second roller configured to rotate in a second direction to lower the tubular joint.

16. A method of extending a tubular string at least partially disposed in a well bore, which comprises:

providing a tubular joint;

gripping the tubular joint using a tubular joint elevator;

elevating the tubular joint using an elevating mechanism concurrently with lowering a top drive to couple the tubular joint to the top drive, wherein the elevating mechanism comprises a plurality of rollers; and applying torque to the tubular joint to join the tubular joint with the tubular string.

17. The method of claim 16, wherein gripping the tubular joint comprises closing a plurality of doors of the tubular joint elevator around the tubular joint.

18. The method of claim 17, wherein gripping the tubular joint further comprises activating a locking mechanism to prevent the doors of the tubular joint elevator from opening.

19. The method of claim 17, further comprising inhibiting or preventing an unintended rotation of the elevator while the plurality of doors is being opened.

20. The method of claim 19, wherein inhibiting or preventing the unintended rotation of the elevator includes at least one of (a) rotating the plurality of doors upwards or downwards while the plurality of doors is being opened and (b) mechanically constraining rotation of the plurality of doors.

21. The method of claim 17, wherein the plurality of doors comprises a first door, a second door, and a third door.

22. The method of claim 21, wherein at least a portion of the second door or third door overlaps the first door.

23. The method of claim 16, wherein the elevating mechanism is arranged in at least a partially ringed configuration around the tubular joint.

24. The method of claim 16, wherein the elevating mechanism forms a ringed configuration sized to receive the tubular joint.

25. The method of claim 16, wherein the plurality of rollers are positioned directly opposed to each other to receive the tubular joint.

26. A method of extending a tubular string at least partially disposed in a well bore, which comprises:

providing a tubular joint;

gripping the tubular joint using a tubular joint elevator;

elevating the tubular joint using an elevating mechanism operably associated with a casing running tool (CRT) to couple an upper end of the tubular joint to the CRT when the elevating mechanism elevates the tubular joint to a height for the CRT to engage the tubular joint, wherein the elevating mechanism comprises a plurality of rollers, the plurality of rollers elevating the tubular joint by rotating when in contact therewith, and each of the plurality of rollers comprise a locking mechanism configured to allow rotation of the roller in a single direction; and applying torque to the tubular joint to join the tubular joint with the tubular string.

27. The method of claim 26, wherein gripping the tubular joint comprises closing a plurality of doors of the tubular joint elevator around the tubular joint.

28. The method of claim 27, further comprising inhibiting or preventing an unintended rotation of the tubular joint elevator while the plurality of doors is being opened.

29. The method of claim 27, wherein gripping the tubular joint further comprises activating a locking mechanism to prevent the doors of the tubular joint elevator from opening.

30. The method of claim 26, wherein the plurality of rollers comprise a first roller configured to rotate in a first direction to elevate the tubular joint and a second roller configured to rotate in a second direction to lower the tubular joint.

* * * * *